US009711053B1

(12) United States Patent
Williamson et al.

(10) Patent No.: US 9,711,053 B1
(45) Date of Patent: Jul. 18, 2017

(54) OFF-SCREEN TRAFFIC INFORMATION INDICATOR

(71) Applicant: Rockwell Collins, Inc., Cedar Rapids, IA (US)

(72) Inventors: Tiffany D. Williamson, Marion, IA (US); David J. Inman, Marion, IA (US); Roger L. Yum, Marion, IA (US); Randy H. Jacobson, Melbourne, FL (US); Thomas C. Olson, Cedar Rapids, IA (US); Bernard S. McCaffrey, Cedar Rapids, IA (US); Michael R. Goodloe, Cedar Rapids, IA (US); Christopher A. Scherer, Cedar Rapids, IA (US)

(73) Assignee: Rockwell Collins, Inc., Cedar Rapids, IA (US)

( * ) Notice: Subject to any disclaimer, the term of this patent is extended or adjusted under 35 U.S.C. 154(b) by 0 days.

(21) Appl. No.: 15/011,190

(22) Filed: Jan. 29, 2016

(51) Int. Cl.

| | |
|---|---|
| ***G08G 5/00*** | (2006.01) |
| ***G08G 5/02*** | (2006.01) |
| ***G08G 5/04*** | (2006.01) |
| ***G08G 5/06*** | (2006.01) |

(52) U.S. Cl.
CPC ..... *G08G 5/0039* (2013.01); *G08G 5/0065* (2013.01); *G08G 5/025* (2013.01); *G08G 5/06* (2013.01)

(58) Field of Classification Search
CPC ..... G08G 5/0039; G08G 5/0065; G08G 5/025
USPC ..... 701/3, 14, 120–122
See application file for complete search history.

(56) References Cited

U.S. PATENT DOCUMENTS

| | | | | |
|---|---|---|---|---|
| 6,694,249 | B1 | 2/2004 | Anderson et al. | |
| 7,755,516 | B2 * | 7/2010 | Clark | G08G 5/0021 340/958 |
| 8,306,745 | B1 | 11/2012 | Clark et al. | |
| 8,335,638 | B2 | 12/2012 | Ridenour et al. | |
| 8,736,633 | B2 | 5/2014 | Gurusamy | |
| 8,742,952 | B1 * | 6/2014 | Bold | G08G 5/0078 340/435 |
| 8,773,288 | B1 * | 7/2014 | Carrico | G08G 5/0021 340/945 |
| 2009/0051570 | A1 * | 2/2009 | Clark | G08G 5/0078 340/971 |
| 2010/0217509 | A1 * | 8/2010 | Ridenour | G08G 5/0078 701/120 |
| 2014/0249737 | A1 | 9/2014 | Meunier et al. | |

* cited by examiner

*Primary Examiner* — Tyler J Lee
(74) *Attorney, Agent, or Firm* — Angel N. Gerdzhikov; Donna P. Suchy; Daniel M. Barbieri

(57) ABSTRACT

An offscreen traffic information indicator system includes signal receivers for receiving traffic messages from proximate air and ground vehicles and a traffic indicator for determining the positions of the host aircraft and the proximate vehicles based on the traffic messages. Based on the locations of the host aircraft and proximate vehicles and their proximity to airport runways, the traffic indicator may designate runways as relevant runways (or receive relevant runway designations from the flight management system of the host aircraft) and designate proximate vehicles as relevant to the host aircraft. A display unit may display, along with a dynamic map of a region near the host aircraft, relevant runway indicators for relevant runways within the mapped region and offscreen traffic indicators for relevant aircraft positioned outside the mapped region.

18 Claims, 7 Drawing Sheets

OFF-SCREEN TRAFFIC INFORMATION INDICATOR

BACKGROUND

Display systems onboard an aircraft at or near an airport facility may incorporate the display of traffic which alerts the pilot or crew of the aircraft to the presence of other traffic (air or ground) in the immediate vicinity. The source of this traffic data may be Traffic Collision Avoidance System (TCAS), Automatic Dependent Surveillance-Broadcast (ADS-B), Traffic Information Services-Broadcast (TIS-B), or some other data source. Onboard display systems may additionally enhance situational awareness by displaying air or ground traffic relevant to surface operations (e.g., takeoff, landing, taxiing from a landing site to a gate or to a takeoff runway) via an Airport Moving Map (AMM). The AMM may be capable of displaying a detailed layout of runways, taxiways, and other features of a given airport.

However, to display airport features in sufficient detail, the pilot or crew may need to zoom into the AMM, enhancing detail but simultaneously decreasing the effective range of the AMM; the more detailed the map, the smaller the area displayed. Therefore the zoomed-in high-detail AMM may not be able to display air or ground traffic which is relevant to air and ground operations (and therefore important to situational awareness) but located outside the area displayed by the AMM (and therefore "offscreen" with respect to the AMM).

SUMMARY

In one aspect, embodiments of the inventive concepts disclosed herein are directed to an offscreen traffic information indicator system. The system may include a signal receiver configured to receive traffic messages associated with other airborne or ground-based vehicles proximate to a host aircraft. The system may include a traffic indicator connected to the signal receiver and to the flight management system of the host aircraft. The traffic indicator may receive a current position and/or projected route of the host aircraft, and determine positions of the proximate vehicles based on the received traffic messages. The traffic indicator may determine the range of an Airport Moving Map (AMM) displayed by a display unit of the host aircraft, and designate one or more proximate vehicles located outside the map range as offscreen vehicles eligible for display (e.g., relevant to the host aircraft or to its projected route) based on vehicle positions. The display unit may display the AMM based on its current range; concurrent with the AMM, the display unit may display offscreen traffic indicators for offscreen vehicles not otherwise displayed by the AMM due to their location outside the range of the AMM.

In a further aspect, embodiments of the inventive concepts disclosed herein are directed to an aircraft-based method for displaying offscreen traffic information. The method may include receiving a position and a projected route of a host aircraft. The method may include receiving traffic messages associated with nearby airborne aircraft, ground-based aircraft, or ground vehicles near the host aircraft and determining the positions of the nearby vehicles based on the traffic messages. The method may include determining the current range of the AMM displayed by a display unit of the host aircraft. The method may include designating nearby relevant vehicles outside the AMM range as offscreen vehicles, based on the position and projected route of the host aircraft and the positions of the nearby vehicles. The method may include displaying, concurrent with the AMM, offscreen traffic indicators for offscreen vehicles not otherwise displayed by the AMM due to their location outside the range of the AMM.

BRIEF DESCRIPTION OF THE DRAWINGS

Implementations of the inventive concepts disclosed herein may be better understood when consideration is given to the following detailed description thereof. Such description makes reference to the included drawings, which are not necessarily to scale, and in which some features may be exaggerated and some features may be omitted or may be represented schematically in the interest of clarity. Like reference numerals in the drawings may represent and refer to the same or similar element, feature, or function. In the drawings.

DETAILED DESCRIPTION OF EXEMPLARY EMBODIMENTS

Figure 1:
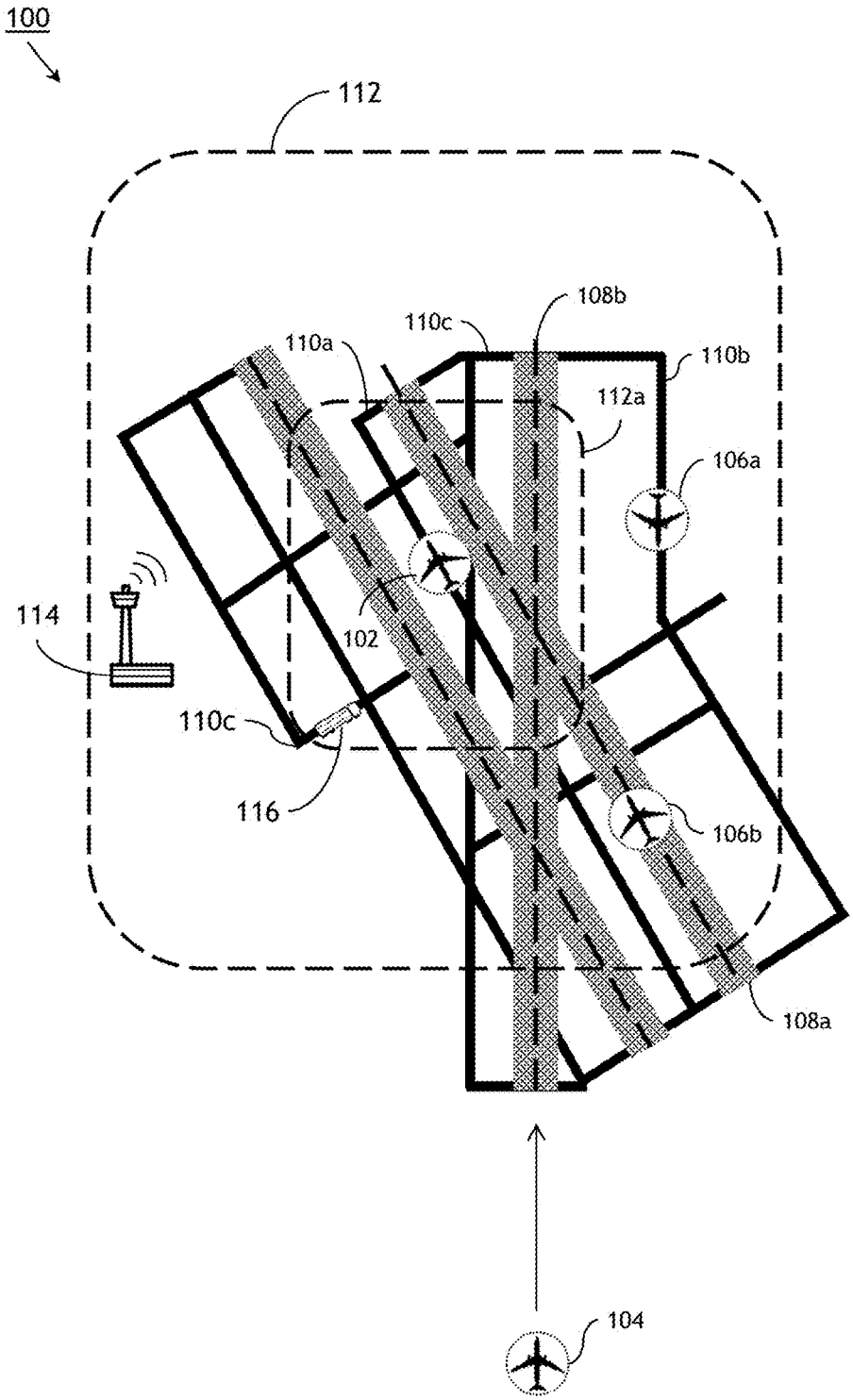
FIG. 1 is an environmental diagram illustrating the positions of relevant aircraft according to an exemplary embodiment of a system according to the inventive concepts disclosed herein.

Before explaining at least one embodiment of the inventive concepts disclosed herein in detail, it is to be understood that the inventive concepts are not limited in their application to the details of construction and the arrangement of the components or steps or methodologies set forth in the following description or illustrated in the drawings. In the following detailed description of embodiments of the instant inventive concepts, numerous specific details are set forth in order to provide a more thorough understanding of the inventive concepts. However, it will be apparent to one of ordinary skill in the art having the benefit of the instant disclosure that the inventive concepts disclosed herein may be practiced without these specific details. In other instances, well-known features may not be described in detail to avoid unnecessarily complicating the instant disclosure. The inventive concepts disclosed herein are capable of other embodiments or of being practiced or carried out in various ways. Also, it is to be understood that the phraseology and terminology employed herein is for the purpose of description and should not be regarded as limiting.

As used herein a letter following a reference numeral is intended to reference an embodiment of the feature or element that may be similar, but not necessarily identical, to a previously described element or feature bearing the same reference numeral (e.g., 1, la, 1*b*). Such shorthand notations are used for purposes of convenience only, and should not be construed to limit the inventive concepts disclosed herein in any way unless expressly stated to the contrary.

Further, unless expressly stated to the contrary, "or" refers to an inclusive or and not to an exclusive or. For example, a condition A or B is satisfied by anyone of the following:

A is true (or present) and B is false (or not present), A is false (or not present) and B is true (or present), and both A and B are true (or present).

In addition, use of the "a" or "an" are employed to describe elements and components of embodiments of the instant inventive concepts. This is done merely for convenience and to give a general sense of the inventive concepts, and "a' and "an" are intended to include one or at least one and the singular also includes the plural unless it is obvious that it is meant otherwise.

Finally, as used herein any reference to "one embodiment," or "some embodiments" means that a particular element, feature, structure, or characteristic described in connection with the embodiment is included in at least one embodiment of the inventive concepts disclosed herein. The appearances of the phrase "in some embodiments" in various places in the specification are not necessarily all referring to the same embodiment, and embodiments of the inventive concepts disclosed may include one or more of the features expressly described or inherently present herein, or any combination of sub-combination of two or more such features, along with any other features which may not necessarily be expressly described or inherently present in the instant disclosure.

Broadly, embodiments of the inventive concepts disclosed herein are directed to a system for indication and display of offscreen traffic by an Airport Moving Map (AMM) displayed by an aircraft-based display unit. The system may enhance situational awareness by indicating, via data display or visual representation, air and ground traffic relevant to a host aircraft and to its projected path, through the air or on the ground. This relevant traffic may include ground-based aircraft or ground vehicles using a nearby runway or taxiway, and airborne traffic on approach to a nearby or relevant runway. The relevant traffic may not otherwise have been displayed by the AMM due to being located outside the active range of the AMM (e.g., if the AMM is zoomed in to enhance detail). The system may further enhance situational awareness by displaying additional information about relevant traffic.

Referring to FIG. 1, an airport 100 in and around which the host aircraft 102 and other aircraft 104, 106 operate may include runways 108*a-b* and taxiways 110*a-b*, which may be fully displayed, partially displayed, or not displayed depending on the effective range 112 of an AMM displayed by a display unit of the host aircraft 102. For example, a greater effective range (112) results in a larger portion of the airport 100 being displayed by the AMM, while a smaller effective range (112*a*) results in a smaller portion displayed in more precise detail. The host aircraft 102 may be airborne and on approach to land at the airport 100, or the host aircraft 102 may be ground-based, proceeding according to a projected route assigned by ground control (114)) along a taxiway 110*a* towards a takeoff from a runway 108*a*. Meanwhile, the proximate ground-based aircraft 106*a-b* may also be in operation at the airport 100, including a ground-based aircraft 106*a* proceeding along taxiway 110*b*, having recently landed on runway 108*b*, and a ground-based aircraft 106*b* having just touched down on runway 108*a*. Furthermore, a fuel truck or other ground vehicle 116 equipped with an ADS-B Out transponder may be in operation along taxiway 110*c*, proximate to the host aircraft 102. The ground-based aircraft 106*b* may be relevant to the host aircraft 102 (as both aircraft 106*b*, 102 are proximate to the same runway 108*a*), while the ground-based aircraft 106*a* and ground vehicle 116 may not be relevant to the host aircraft 102 (as neither is proximate to the runway 108*a*). Furthermore, an airborne aircraft 104 may be on approach to the airport 100 toward a landing on the runway 108*b*. The airborne aircraft 104 may be relevant to the host aircraft 102 as the paths or routes of the two aircraft 102, 104 may eventually intersect; alternatively, the host aircraft 102 may be held on the taxiway 108*a* while the airborne aircraft 104 lands).

Figure 2:
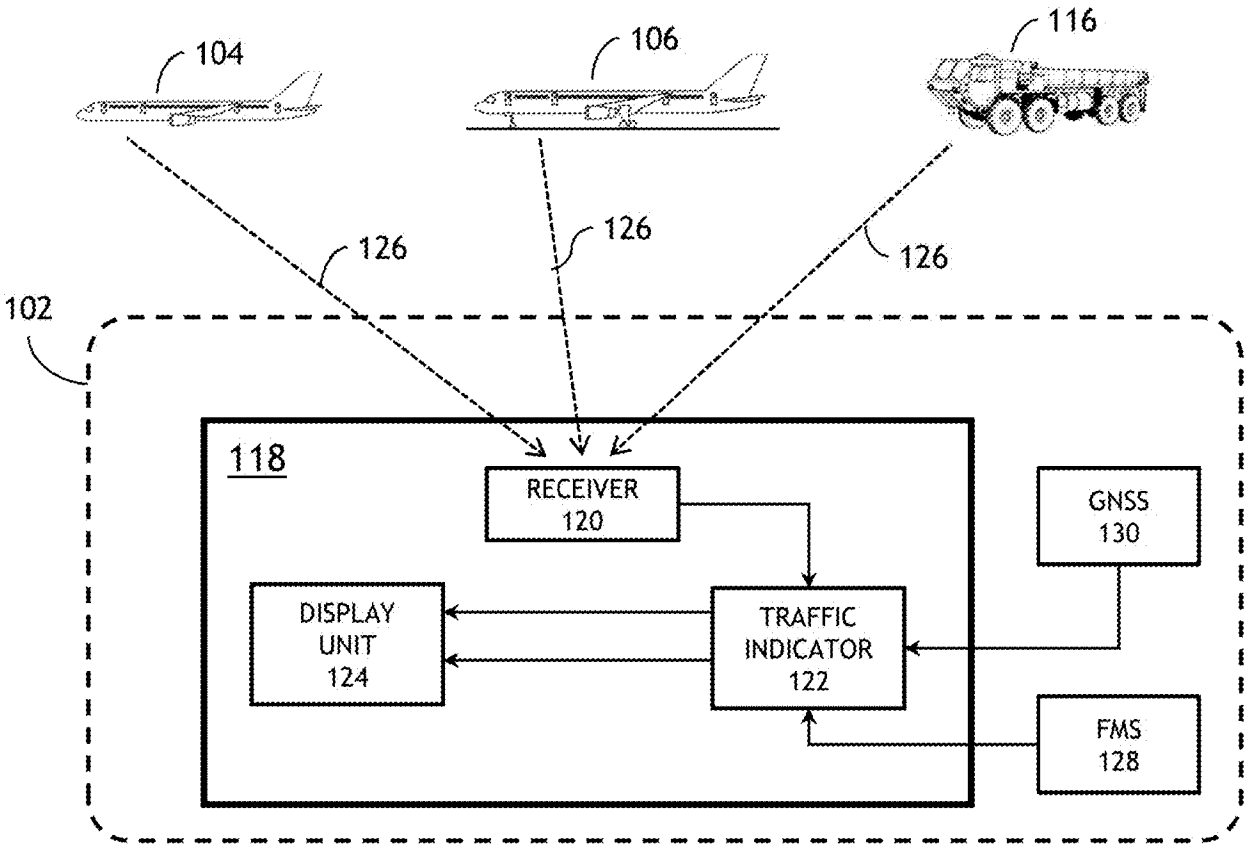
FIG. 2 illustrates a block diagram of an exemplary embodiment of a system according to the inventive concepts disclosed herein.

Referring now to FIG. 2, an exemplary embodiment of an offscreen traffic indicator system 118 according to the inventive concepts disclosed herein includes a signal receiver 120, a traffic indicator 122, and a display unit 124. The offscreen traffic indicator system 118 may be incorporated into a cockpit-mounted avionics system aboard the host aircraft 102, or incorporated into an electronic flight bag (EFB, not shown) or similar mobile communications or computing device. The signal receiver 120 may regularly receive traffic messages (126) transmitted by other aircraft 104, 106 or ground vehicles 116 proximate to the host aircraft 102 (FIG. 1). Proximate vehicles may include any ground-based aircraft 106 or ground vehicles 116 in operation at the airport 100 (FIG. 1) at which the host aircraft 102 is currently in operation. Proximate vehicles may include any airborne aircraft 104 on approach to, or on initial climb from (i.e., having recently taken off), the airport 100, within a radius of 5 NM. If the host aircraft 102 is airborne and on approach to an airport 100, proximate vehicles may include any aircraft 104, 106 or ground vehicles 116 in operation at, on approach to, or on initial climb from the airport 100, within a radius of 5 NM. Traffic messages 126 may include Traffic Collision and Avoidance System (TCAS) messages, Automatic Dependent Surveillance-Broadcast (ADS-B) messages, or any other appropriate messages identifying the presence and/or position of an aircraft 104, 106 or ground vehicle 116. Traffic messages 126 may include messages transmitted directly by the aircraft 104, 106 and ground vehicles 116 (e.g., ADS-B Out messages automatically transmitted to ground stations and neighboring aircraft) or messages relayed to the signal receiver 120 via ground control facilities (114, FIG. 1) or by other ground stations (e.g., ADS-B ground stations).

The traffic indicator 122 may include one or more processors for determining the positions of the other aircraft 104, 106 and ground vehicles 116 by decoding the received traffic messages 126. The traffic indicator 122 may determine the current position of the host aircraft 102 by querying the flight management system (FMS) 128 of the host aircraft 102 for a projected position based on a flight plan or projected route of the host aircraft 102. The traffic indicator 122 may determine an absolute position of the host aircraft 102 by querying a position receiver 130 (such as a Global Navigation Satellite System (GNSS), Global Positioning System (GPS), or other similar satellite-based absolute position receiver) or receive the absolute position of the host aircraft 102 from the FMS 128. Based on the position of the host aircraft 102 and its proximity to a given runway, the traffic indicator 122 and/or the FMS 128 may designate the runway as a relevant runway. The traffic indicator 122 may designate an airborne aircraft 104, a ground-based aircraft 106, or a ground vehicle 116 as relevant traffic based on either the relevant runway designation received from the FMS 128, or based on its own proximity-based relevant runway designation (i.e., the relevant runway designation generated by the traffic indicator 122). The FMS 128 may include one or more DO-317 compliant Airborne Surveillance Applications (ASA) or ADS-B for Enhanced Traffic Situational Awareness on the Airport Surface (ATSA-SURF) compliant applications for determination of relevant runways and relevant traffic based on the positions and flight plans of the host aircraft 102 and the other aircraft 104, 106 and ground vehicles 116. Referring back to FIG. 1, the effective range 112 of the AMM may be zoomed in to a smaller effective range 112*a* to enhance detail for aircraft operating on the runways 108*a-b* and taxiways 110*a-c* of the airport 100. In one embodiment, the offscreen traffic indicator system 118 may be embodied in a ground control facility 114 at or near the airport 100, and may coordinate the positions of, and display relevant runway indicators and offscreen traffic indicators relative to, multiple host aircraft 102. The offscreen traffic indicator system 118 embodied in the ground control facility 114 may display offscreen traffic information customized for each aircraft operating at (or on approach to) the airport 100 (e.g., ground-based aircraft 106*a-b* and airborne aircraft 104). The customized offscreen traffic information received by each aircraft may treat that aircraft as a host aircraft, e.g., by determining relevant runways and/or designating relevant offscreen traffic based on the individual position of each aircraft. For example, from the perspective of ground-based aircraft 106*b*, the runways 108*a-b* may both be relevant runways, and the host aircraft 102 (preparing to take off from runway 108*a*) may be relevant traffic. From the perspective of the airborne aircraft 104, the host aircraft 102 and ground-based aircraft 106*b* (associated with runway 108*a*, which intersects the runway 108*b* on which the airborne aircraft 104 is on approach to) may both be relevant traffic but not currently displayed aboard the airborne aircraft 104 due to its distance from the airport 100.

Figure 3A:
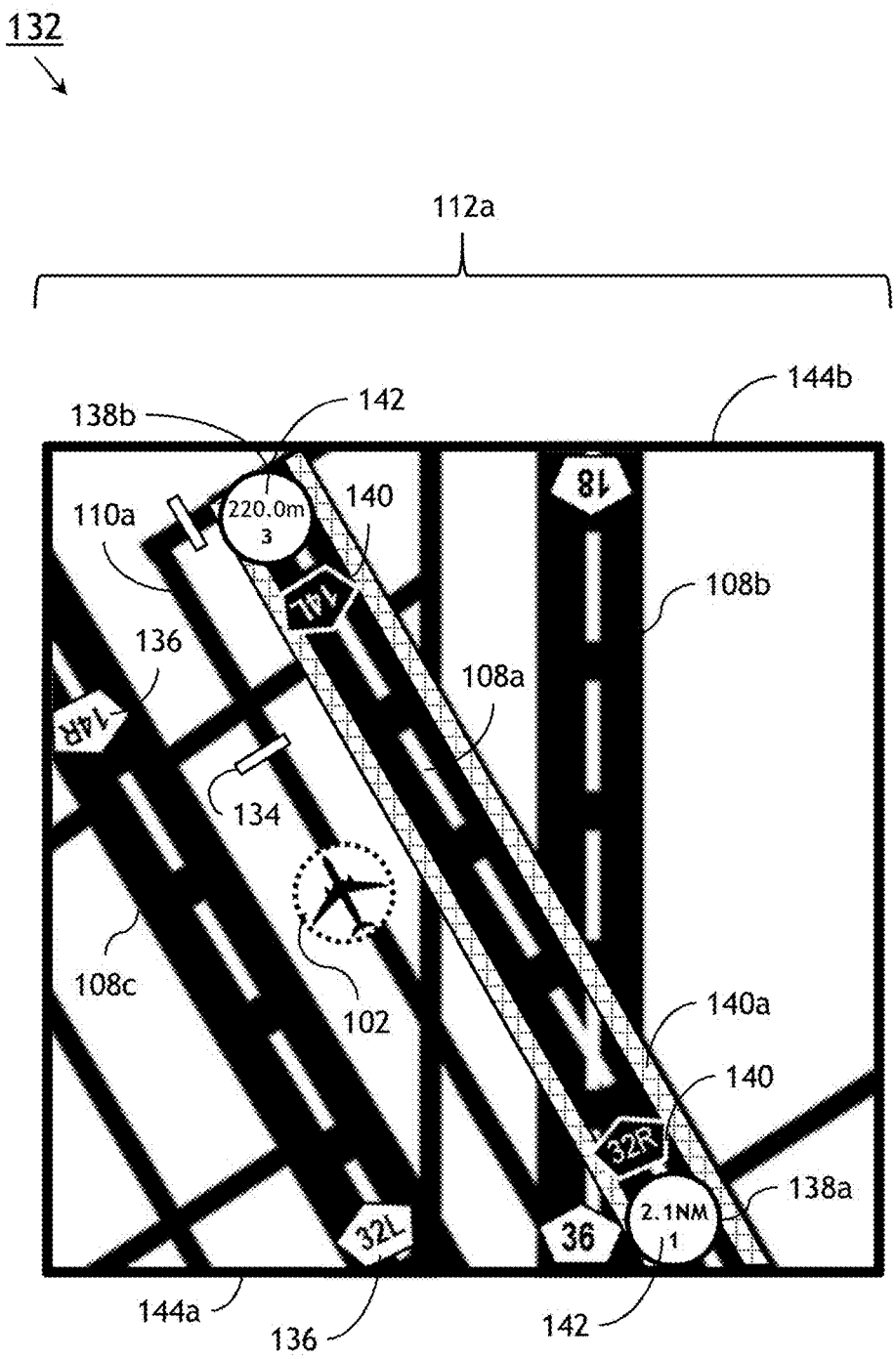
FIGS. 3A, 3B and 3C illustrate exemplary embodiments of a system according to the inventive concepts disclosed herein.

Referring to FIG. 3A, an AMM 132 displayed by the display unit 124 (FIG. 2) may include runways 108*a-c*, a taxiway 110*a* including a hold point 134, runway indicators 136 corresponding to the orientations of the runways 108*a-c*, offscreen traffic indicators 138*a-b* (which may include relevant runway indicators 140-140*a* and movement characteristics 142), and map edges 144*a-b*. For example, the AMM 132 may correspond to an overhead view of the airport 100 (FIG. 1) or a segment thereof at a given effective range 112*a* (FIG. 2). The host aircraft 102 may be positioned on the taxiway 110*a* proceeding toward a takeoff on the adjacent runway 108*a*, which runway 108*a* may be designated a relevant runway. The AMM 132 may superimpose or otherwise display relevant runway indicators 140*a* by highlighting, shading, patterning, or coloring the runway 108*a*. The AMM 132 may display relevant runway indicators 140 by highlighting, patterning, shading, or coloring the runway indicators associated with the relevant runway 108*a* (as opposed to the runway indicators 136 associated with runways 108*b-c*). Referring also to FIG. 1, at a smaller effective range 112*a*, other airborne and ground-based traffic (104, 106*a-b*, 116) may not be within the effective range 112*a* and therefore may not be displayed by the AMM 132, even though the airborne and ground-based traffic 104, 106*a-b*, 116 is relevant to the host aircraft 102. The AMM 132 may enhance situational awareness of offscreen traffic by displaying an airborne offscreen traffic indicator 138*a* corresponding to one or more airborne aircraft 104 (FIG. 1). For example, an airborne aircraft (not shown) may be on approach to land on the relevant runway 108*a*. The traffic indicator 122 (FIG. 2) may receive traffic messages 126 (FIG. 2) via the signal receiver 120 (FIG. 2), the traffic messages 126 corresponding to one or more current positions of the airborne aircraft (to be determined by the traffic indicator 122 based on the received traffic messages 126). Based on these determined positions, the AMM 132 may display an airborne offscreen traffic indicator 138*a* as a bubble or shape positioned at or near a bottom map edge 144*a* corresponding to the position of the airborne aircraft relative to the host aircraft 102. The airborne offscreen traffic indicator 138*a* may include movement characteristics 142 of the airborne aircraft determined by the traffic indicator 122 (e.g., from two or more determined positions of the airborne aircraft over time). For example, the movement characteristics 142 associated with the airborne offscreen traffic indicator 138*a* may include the distance (e.g., 2.1 NM) of the airborne aircraft, the heading of (or bearing to) the airborne aircraft, the velocity (e.g., 200 km/h) of the airborne aircraft, the altitude of the airborne aircraft, the count of the airborne aircraft (e.g., 1, indicating a single aircraft) and the intercept time to the airborne aircraft (based on, e.g., its determined velocity and distance). The airborne offscreen traffic indicator 138*a* may be shaded or colored differently than the ground-based offscreen traffic indicator 138*b* in order to easily distinguish the two offscreen traffic indicators 138*a-b*. Similarly, the ground-based offscreen traffic indicator 138*a* corresponding to one or more ground-based aircraft or ground vehicles (not shown) may be positioned at or near a top map edge 144*b* corresponding to the position of the ground-based aircraft or ground vehicles relative to the host aircraft 102. For example, the ground-based offscreen traffic indicator 138*b* may include movement characteristics 142 indicating that three (3) ground-based aircraft or ground vehicles are located near the host aircraft 102 but offscreen (e.g., outside the current range (112*a*, FIG. 1) of the AMM 132), the closest aircraft at a distance of 220.0 m from the host aircraft 102. If an offscreen traffic indicator 138*a-b* is associated with multiple aircraft or ground vehicles (and therefore multiple sets of movement characteristics 142) the movement characteristics 142 of the offscreen traffic indicator 138*a-b* may default to the closest (or most relevant) aircraft or ground vehicle, updating the movement characteristics 142 as new information becomes available to the traffic indicator 122.

Figure 3B:
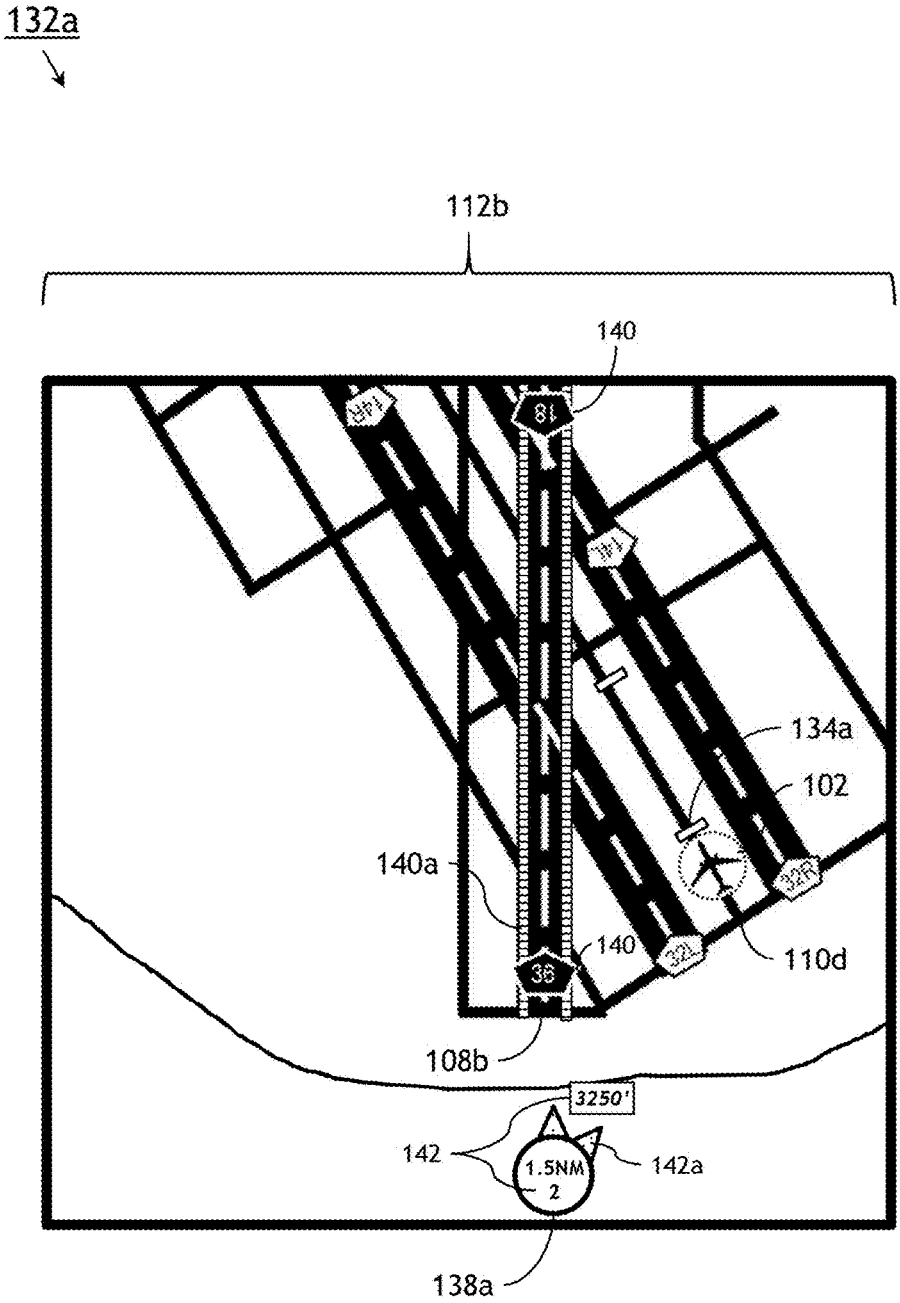

Referring to FIG. 3B, an AMM 132*a* may be implemented by the display unit 124 (FIG. 2) similarly to the AMM 132 of FIG. 3A, except that the AMM 132*a* may be set to a greater current range 112*b* (e.g., a current range incorporating a larger display area and correspondingly lower level of detail) and display additional movement characteristics 142*a* concurrent with the airborne offscreen traffic indicator 138*a*. For example, the host aircraft 102 may be held at hold point 134*a* on the taxiway 110*d*; the relevant runway 108*b* may be designated as active (whereby the AMM 132*a* may display relevant runway indicators 140*a* over the relevant runway 108*b*, and highlight the associated runway indicators (140) of the runway 108*b*) because the flight plan of the host aircraft 102 includes crossing the relevant runway 108*b*, on which two offscreen airborne aircraft (not shown) are on approach to land but outside the current range 112*b* of the AMM 132*a*. The movement characteristics 142 of the airborne offscreen traffic indicator 138*a* may indicate that the closest of the two aircraft is 1.5 NM distant from the host aircraft 102 at an altitude of 3250 ft. Additional movement characteristics 142*a* may graphically indicate the respective headings of the two airborne aircraft based on their determined positions over time.

Figure 3C:
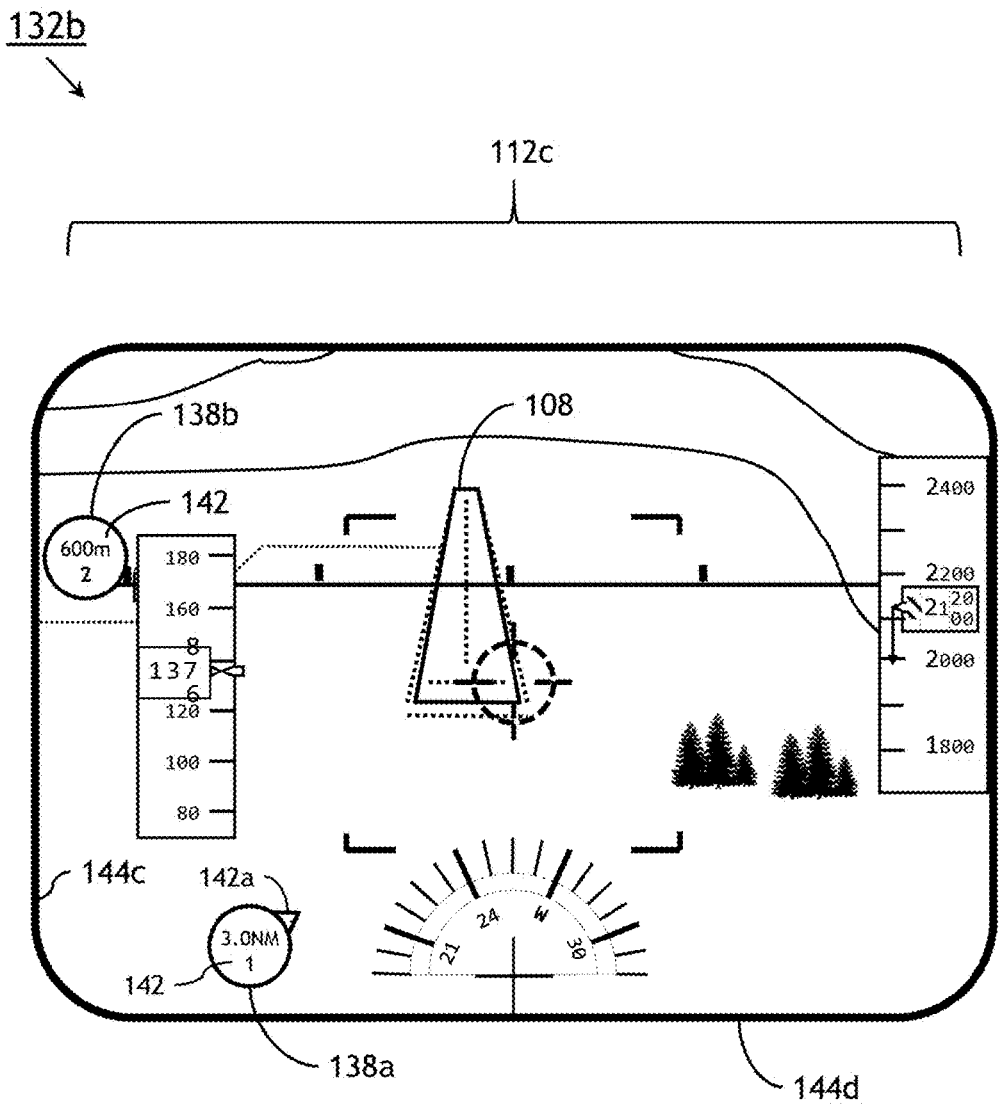

Referring to FIG. 3C, a synthetic vision system (SVS) display 132*b* may be implemented by the display unit 124 (FIG. 2) similarly to the AMM 132-132*a* of FIGS. 3A-3B, except that the SVS display 132*b* may be generated and displayed by a synthetic vision system (SVS) aboard a host aircraft (not shown) preparing to land on a runway 108. The SVS may display a three-dimensional SVS display 132*b* to provide enhanced situational awareness in darkness or degraded visual environments (DVE) via forward view (as opposed to the overhead views of the AMMs 132-132*a*). The SVS display 132*b* may have a defined field of view 112*c* similar to the range 112*a-b* of the AMMs 132-132*a*, but based on an angle of view (e.g., 22.5 degrees, 45 degrees) from the perspective of the host aircraft rather than an overhead view. The display unit 124 may include a helmet mounted display (not shown) which generates the SVS display 132*b* based on the current field of view of the pilot of the host aircraft (e.g., an "invisible aircraft" display, the perspective of which moves with the pilot's head).

The SVS display 132*b* may not include relevant runway indicators 140-140*a* (FIG. 3A-B) if there is only one runway 108 to display. The SVS display 132*b* may display a ground-based offscreen traffic indicator 138*b* and movement characteristics 142 corresponding to two (2) ground-based aircraft (not shown) offscreen, the closest of which is at a distance of 600 m from the host aircraft. For example, the flight plans of the offscreen ground-based aircraft may include taxiing to the runway 108 for takeoff, rendering them relevant traffic to the onboard FMS 128 (FIG. 2) of the host aircraft. The ground-based offscreen traffic indicator 138*b* may be positioned at or near a left edge 144*c* of the field of view 112*c* of the SVS display 132*b*, based on the determined relative position of one or more of the corresponding ground-based aircraft. The SVS display 132*b* may similarly enhance situational awareness of relevant airborne traffic (not shown) outside the field of view 112*c* (e.g., airborne traffic behind the host aircraft or otherwise outside the forward field of view) by displaying an airborne offscreen traffic indicator 138*a* positioned along a bottom edge 144*d* of the field of view 112*c* of the SVS display 132*b* (based on the determined relative position of the corresponding airborne aircraft, roughly behind and to port of the host aircraft). For example, the airborne offscreen traffic indicator 138*a* may correspond to a single aircraft 3.0 NM distant from the host aircraft and proceeding on a northwesterly heading of approximately 300 degrees (as indicated by the movement characteristics 142-142*a* associated with the airborne offscreen traffic indicator 138*a*).

Figure 4A:
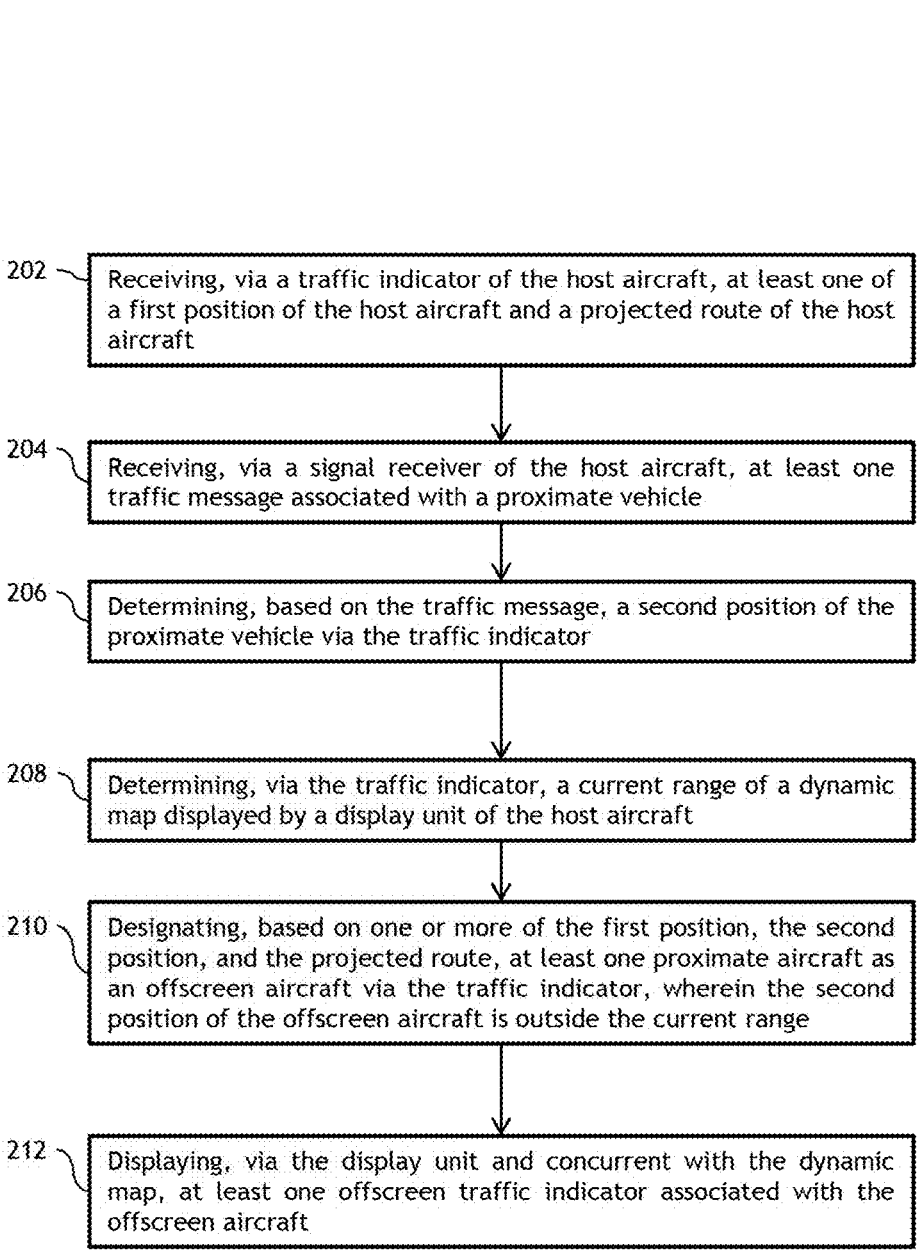
FIGS. 4A and 4B are process flow diagrams illustrating a method according to embodiments of the inventive concepts disclosed herein.

Referring now to FIG. 4A, an exemplary embodiment of a method 200 for displaying offscreen traffic information according to the inventive concepts disclosed herein may include one or more of the following steps. At a step 202, the traffic indicator 122 receives a position and a projected route of the host aircraft 102. The position may be received from a position receiver 130 or the FMS 128 of the host aircraft 102.

At a step 204, a signal receiver 120 of the host aircraft 102 receives traffic messages 126 associated with proximate aircraft 104, 106 or ground vehicles 116.

At a step 206, the traffic indicator 122 determines positions of the proximate aircraft 104, 106 and ground vehicles 116 based on the received traffic messages 126.

At a step 208, the traffic indicator 122 determines the current range 112 of an AMM 132 displayed by a display unit 124 of the host aircraft 102. The current range 112 of the AMM 132 may be indicated by map edges 144*a-b*. The display unit 124 may be a synthetic vision system (SVS) configured to display a three-dimensional SVS display 132*b* having a field of view 112*c* indicated by field edges 144*c-d*.

At a step 210, the traffic indicator 122 designates as offscreen traffic at least one proximate aircraft 104, 106 or proximate ground vehicle 116 based on the positions of the host aircraft 102 and the proximate aircraft 104, 106 or ground vehicle 116, where the position of the proximate aircraft 104, 106 or ground vehicle 116 is outside the current range 112 of the AMM 132. For example, the traffic indicator 122 may designate an airborne aircraft 104, a ground-based aircraft 106, or a ground vehicle 116 as offscreen traffic, based on the position of the proximate aircraft 104, 106 or ground vehicle 116 and its proximity to a relevant runway 108. The traffic indicator may receive a designation of a runway 108 near the host aircraft 102 as a relevant runway from the FMS 128, or generate a designation of the runway 108 as a relevant runway based on the position of the host aircraft 102 and its proximity to the runway 108. The traffic indicator 122 may select either the relevant runway designation received from the FMS 128 or the self-generated relevant runway designation in designating a proximate aircraft 104, 106 or proximate ground vehicle 116 as relevant offscreen traffic.

At a step 212, the display unit 124 displays, concurrent with the AMM 132, an offscreen traffic indicator 138*a-b* associated with an offscreen aircraft 104, 106 or ground vehicle 116. For example, the display unit 124 may display a ground-based offscreen traffic indicator 138*b* associated with a ground-based aircraft 106 or ground vehicle 116, and an airborne offscreen traffic indicator 138*a* associated with an airborne aircraft 104. The display unit 124 may display the offscreen traffic indicator 138*a-b* at or near a map edge 144*a-b* of the AMM 132, based on the relative position of the offscreen aircraft or vehicle. The offscreen traffic indicator 138*a-b* may be displayed as part of an SVS display 132*b*, displayed near a field edge 144*c-d* of the field of view 112*c* of the SVS display 132*b*. The offscreen traffic indicator 138*a-b* may include a relevant runway indicator 140-140*a* associated with a relevant runway designation, where the relevant runway 108 is at least partially within the current range 112 of the AMM 132.

Figure 4B:
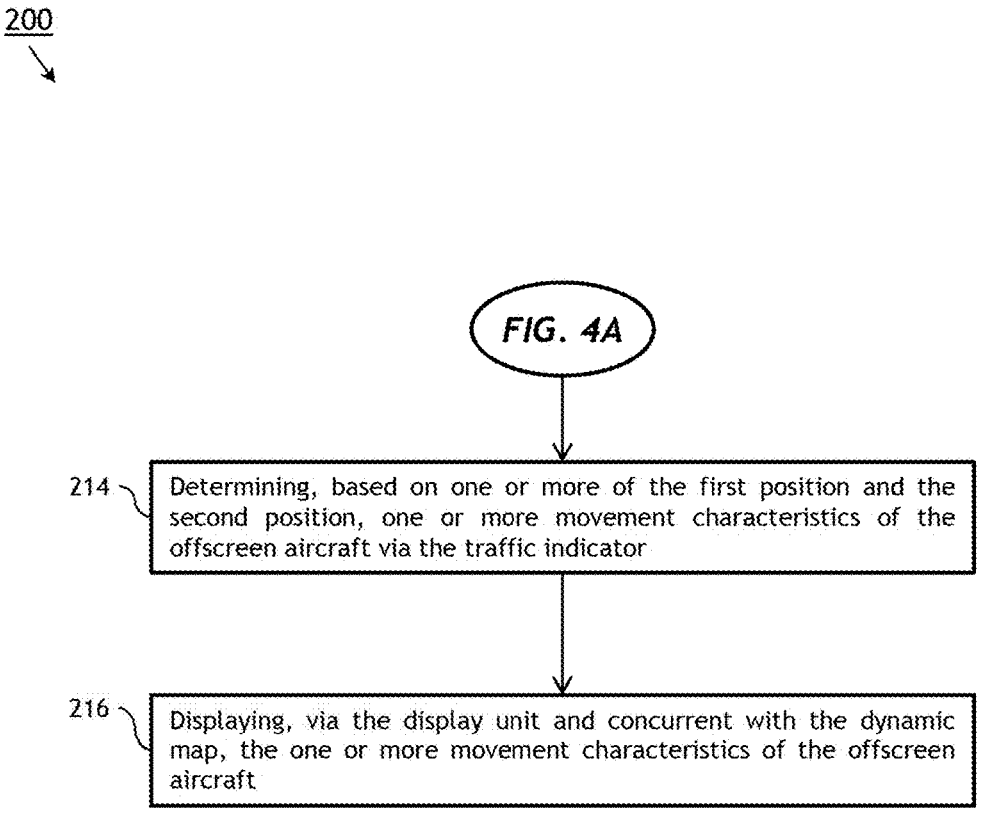

Referring to FIG. 4B, the method 200 may include additional steps 214 and 216. At the step 214, the traffic indicator 122 determines movement characteristics 142-142*a* of the offscreen aircraft 104, 106 or ground vehicle 116. For example, based on the position of the offscreen aircraft 104, 106 or ground vehicle 116, the traffic indicator 122 may determine a path of the offscreen aircraft or vehicle, a heading of (or bearing to) the offscreen aircraft or vehicle, an altitude of the offscreen aircraft or vehicle, a velocity of the offscreen aircraft or vehicle, a count of the offscreen aircraft or vehicle, an intercept time to the offscreen aircraft or vehicle, or an airborne/ground-based status of the offscreen aircraft or vehicle. Movement characteristics 142-142*a* may be superimposed over, or incorporated with, offscreen traffic indicators 138*a-b*.

At the step 216, the display unit 124 displays the determined movement characteristics 142-142*a* concurrent with the AMM 132.

As will be appreciated from the above, systems and methods according to embodiments of the inventive concepts disclosed herein may enhance situational awareness by alerting the pilot and crew of a host aircraft operating at or near an airport to the positions, movement, and activity of aircraft that may intersect with the path or flight plan of the host aircraft, but which may not otherwise be displayed by the AMM or SVS onboard the host aircraft if the positions of the other aircraft are beyond the current map range of the AMM (or the current field of view of the SVS).

It is to be understood that embodiments of the methods according to the inventive concepts disclosed herein may include one or more of the steps described herein. Further, such steps may be carried out in any desired order and two or more of the steps may be carried out simultaneously with one another. Two or more of the steps disclosed herein may be combined in a single step, and in some embodiments, one or more of the steps may be carried out as two or more sub-steps. Further, other steps or sub-steps may be carried in addition to, or as substitutes to one or more of the steps disclosed herein.

From the above description, it is clear that the inventive concepts disclosed herein are well adapted to carry out the objects and to attain the advantages mentioned herein as well as those inherent in the inventive concepts disclosed herein. While presently preferred embodiments of the inventive concepts disclosed herein have been described for purposes of this disclosure, it will be understood that numerous changes may be made which will readily suggest themselves to those skilled in the art and which are accomplished within the broad scope and coverage of the inventive concepts disclosed and claimed herein.

We claim:

1. An offscreen traffic information indicator system, comprising:

at least one signal receiver of a host aircraft, the at least one signal receiver configured to receive at least one traffic message associated with a vehicle proximate to the host aircraft;

at least one traffic indicator coupled to the at least one signal receiver and to a flight management system of the host aircraft, the at least one traffic indicator including at least one processor configured to:

receive at least one of a first position of the host aircraft and a projected route of the host aircraft;

determine at least one second position of the at least one proximate vehicle based on the at least one traffic message;

determine at least one current range of a dynamic map displayed by a display unit of the host aircraft;

designate, based on one or more of the at least one first position, the at least one projected route, and the at least one second position, at least one proximate vehicle as an offscreen vehicle, wherein the second position of the at least one offscreen vehicle is outside the at least one current range; and designate, based on the at least one first position, at least one runway of the dynamic map as a relevant runway;

the at least one display unit configured to:

display the at least one dynamic map based on the at least one current range;

display, concurrent with the at least one dynamic map, at least one offscreen traffic indicator associated with the at least one offscreen vehicle; and display, concurrent with the at least one dynamic map, at least one relevant runway indicator corresponding to the at least one relevant runway.

2. The system of claim 1, wherein the at least one traffic indicator is further coupled to a position receiver of the host aircraft and configured to receive the at least one first position from at least one of the flight management system and the at least one position receiver.

3. The system of claim 1, wherein the at least one traffic indicator is configured to determine, based on one or more of the at least one first position and the at least one second position, one or more movement characteristics of the at least one offscreen vehicle including at least one of a path of the at least one offscreen vehicle, a heading of the at least one offscreen vehicle, a bearing to the at least one offscreen vehicle, a distance to the at least one offscreen vehicle, a velocity of the at least one offscreen vehicle, an altitude of the at least one offscreen vehicle, a count of the at least one offscreen vehicle, an airborne status of the at least one offscreen vehicle, a ground-based status of the at least one offscreen air vehicle craft, and an intercept time of the at least one offscreen vehicle.

4. The system of claim 3, wherein the at least one display unit is configured to display the one or more movement characteristics of the at least one offscreen vehicle.

5. The system of claim 1, wherein the at least one display unit is configured to:

define one or more first edges of the dynamic map, the one or more first edges associated with the at least one current range; and display the at least one offscreen traffic indicator on, or proximate to, the one or more first edges based on the at least one second position.

6. The system of claim 1, wherein the at least one traffic indicator is configured to designate as an offscreen vehicle, based on one or more of the at least one first position, the at least one second position, the at least one relevant runway, and the at least one projected route, at least one of a) a ground-based aircraft proximate to the at least one relevant runway, b) an airborne aircraft proximate to the at least one relevant runway, and c) a ground vehicle proximate to the at least one relevant runway, wherein the second position of the at least one offscreen vehicle is outside the at least one current range.

7. The system of claim 1, wherein:

the at least one display unit includes a synthetic vision system (SVS) configured to display the at least one dynamic map based on at least one non-overhead perspective; and the at least one display unit is configured to display the at least one offscreen traffic indicator on, or proximate to, at least one second edge of the dynamic map based on the at least one second position.

8. The system of claim 1, wherein the at least one signal receiver includes at least one Automatic Dependent Surveillance-Broadcast (ADS-B) compatible receiver.

9. The system of claim 1, wherein the system is embodied in at least one of an electronic flight bag, a mobile communications device, and a cockpit mounted avionics display system.

10. The system of claim 1, wherein the host aircraft is a first host aircraft of one or more host aircraft, and the system is embodied in a ground-based control system wirelessly coupled to the one or more host aircraft.

11. An aircraft-based method for displaying offscreen traffic information, the method comprising:

receiving, via at least one traffic indicator of a host aircraft, at least one of a first position of the host aircraft and a projected route of the host aircraft;

receiving, via at least one signal receiver of the host aircraft, at least one traffic message associated with a proximate vehicle;

determining, based on the at least one traffic message, at least one second position of the at least one proximate vehicle via at least one traffic indicator of the host aircraft;

determining, via the at least one traffic indicator, at least one current range of a dynamic map displayed by a display unit of the host aircraft;

designating, via the at least one traffic indicator, at least one proximate vehicle as an offscreen vehicle based on one or more of the first position, the at least one second position, and the projected route, wherein the at least one second position of the offscreen vehicle is outside the at least one current range;

designating, based on the at least one first position, at least one runway of the dynamic map as a relevant runway;

displaying, via the at least one display unit and concurrent with the at least one dynamic map, at least one relevant runway indicator corresponding to the at least one relevant runway; and displaying, via the at least one display unit and concurrent with the at least one dynamic map, at least one offscreen traffic indicator associated with the at least one offscreen vehicle.

12. The method of claim 11, wherein receiving, via at least one traffic indicator of a host aircraft, at least one of a first position of the host aircraft and a projected route of the host aircraft includes:

receiving, via at least one traffic indicator of a host aircraft, at least one first position of the host aircraft from at least one of a position sensor of the host aircraft and a flight management system of the host aircraft; and receiving, via the at least one traffic indicator, at least one projected route of the host aircraft from the flight management system.

13. The method of claim 11, further comprising:

determining, based on one or more of the at least one first position and the at least one second position, one or more movement characteristics of the at least one offscreen vehicle via the at least one traffic indicator, the one or more movement characteristics including at least one of a path of the at least one offscreen vehicle, a heading of the at least one offscreen vehicle, a bearing to the at least one offscreen vehicle, a distance to the at least one offscreen vehicle, a velocity of the at least one offscreen vehicle, a count of the at least one offscreen vehicle, an altitude of the at least one offscreen vehicle, an airborne status of the at least one offscreen vehicle, a ground-based status of the at least one offscreen vehicle, and an intercept time of the at least one offscreen vehicle; and displaying, via the at least one display unit and concurrent with the dynamic map, the one or more movement characteristics of the at least one offscreen vehicle.

14. The method of claim 11, wherein displaying, via the at least one display unit and concurrent with the at least one dynamic map, at least one offscreen traffic indicator associated with the at least one offscreen vehicle includes:

displaying, via the at least one display unit and concurrent with the dynamic map, at least one offscreen traffic indicator associated with the at least one relevant aircraft on, or proximate to, one or more first edges of the dynamic map.

15. The method of claim 11, wherein designating, via the at least one traffic indicator, at least one proximate vehicle as an offscreen vehicle based on one or more of the first position, the at least one second position, and the projected route, wherein the at least one second position of the offscreen vehicle is outside the at least one current range includes:

designating, via the at least one traffic indicator, at least one of a) a ground-based aircraft proximal to the at least one relevant runway, b) an airborne aircraft on approach to the at least one relevant runway, and c) a ground vehicle proximate to the at least one relevant runway as an offscreen vehicle based on one or more of the first position, the at least one second position, the at least one relevant runway designation, and the projected route, wherein the at least one second position of the offscreen vehicle is outside the at least one current range.

16. The method of claim 11, wherein displaying, via the at least one display unit and concurrent with the at least one dynamic map, at least one offscreen traffic indicator associated with the at least one offscreen vehicle includes displaying, via at least one synthetic vision system (SVS) configured to display the at least one dynamic map based on at least one non-overhead perspective and concurrent with the at least one dynamic map, at least one offscreen traffic indicator associated with the at least one offscreen vehicle at, or proximate to, one or more second edges of the at least one field of view.

17. The system of claim 1, wherein the at least one display unit is configured to display the at least one relevant runway indicator via one or more of:

highlighting, patterning, shading, and coloring the at least one relevant runway;

and highlighting, patterning, shading, and coloring at least one runway indicator corresponding to the relevant runway.

18. The method of claim 11, wherein displaying, via the at least one display unit and concurrent with the at least one dynamic map, at least one relevant runway indicator corresponding to the relevant runway includes:

one or more of highlighting, patterning, shading, and coloring the at least one relevant runway; and highlighting, patterning, shading, and coloring at least one runway indicator corresponding to the relevant runway.

* * * * *